US011656042B2

(12) United States Patent
Durham, III

(10) Patent No.: US 11,656,042 B2
(45) Date of Patent: May 23, 2023

(54) BOLT ASSEMBLY

(71) Applicant: Claude A. Durham, III, Lakeside, CA (US)

(72) Inventor: Claude A. Durham, III, Lakeside, CA (US)

( * ) Notice: Subject to any disclaimer, the term of this patent is extended or adjusted under 35 U.S.C. 154(b) by 0 days.

(21) Appl. No.: 17/105,396

(22) Filed: Nov. 25, 2020

(65) Prior Publication Data

US 2021/0156633 A1 May 27, 2021

Related U.S. Application Data

(63) Continuation-in-part of application No. 17/019,686, filed on Sep. 14, 2020, now abandoned, which is a continuation-in-part of application No. 15/718,081, filed on Sep. 28, 2017, now abandoned.

(60) Provisional application No. 62/906,161, filed on Sep. 26, 2019, provisional application No. 62/400,826, filed on Sep. 28, 2016.

(51) Int. Cl.

| | |
|---|---|
| ***F41A 3/70*** | (2006.01) |
| ***F41A 3/82*** | (2006.01) |
| ***F41A 3/26*** | (2006.01) |

(52) U.S. Cl.

CPC ..... *F41A 3/70* (2013.01); *F41A 3/26* (2013.01); *F41A 3/82* (2013.01)

(58) Field of Classification Search

CPC ..... F41A 3/70; F41A 3/26; F41A 3/82

See application file for complete search history.

(56) References Cited

U.S. PATENT DOCUMENTS

| | | | | | |
|---|---|---|---|---|---|
| 1,290,855 | A * | 1/1919 | Wesson | F41A 3/64 | 89/185 |
| 1,344,991 | A * | 6/1920 | Cunningham | F41A 3/26 | 89/154 |
| 2,403,306 | A * | 7/1946 | Sampson | F41A 3/82 | 89/197 |
| 3,363,351 | A * | 1/1968 | Smith | F41A 3/82 | 89/197 |
| 3,366,011 | A * | 1/1968 | Sturtevant | F41A 3/70 | 89/198 |
| 4,562,659 | A * | 1/1986 | Neta | F41A 35/06 | 42/71.01 |
| 4,932,148 | A * | 6/1990 | Barrett | F41A 19/10 | 89/14.3 |
| 5,710,389 | A * | 1/1998 | Canaday | F41A 3/82 | 89/194 |

(Continued)

*Primary Examiner* — Michelle Clement

(74) *Attorney, Agent, or Firm* — Bennet K. Langlotz; Langlotz Patent & Trademark Works, LLC

(57) ABSTRACT

A bolt assembly has a rear block configured for connection at the rear end of the bolt passage, a bolt carrier configured to reciprocate in the bolt passage, a support element between the rear block and the bolt carrier, a first spring between the support element and the rear block, the bolt carrier defining a bore, the support element including a guide rod slidably received in the bore, and a second spring encompassing the guide rod, having a rear end abutting the support element, and a forward portion received in the bore. The bolt carrier may include a bolt carrier body, and the bolt carrier may include a weight portion movably connected to the bolt carrier body. The weight portion may define a through hole receiving an intermediate portion of the guide rod and an intermediate portion of the second spring.

17 Claims, 12 Drawing Sheets

(56) References Cited

U.S. PATENT DOCUMENTS 5,770,814 A * 6/1998 Ealovega ..... F41A 19/04 89/131
5,909,002 A * 6/1999 Atchisson ..... F41A 3/70 42/1.06
6,829,974 B1 * 12/2004 Gwinn, Jr. ..... F41A 3/84 89/130
6,848,351 B1 * 2/2005 Davies ..... F41A 3/94 89/193
7,131,367 B1 * 11/2006 Boerschig ..... F41A 3/70 42/1.06
8,296,984 B2 * 10/2012 Kincel ..... F41C 23/06 42/1.06
8,955,422 B1 * 2/2015 Schumacher ..... F41A 3/82 89/193
9,021,935 B1 * 5/2015 Kellgren ..... F41A 7/00 89/193
9,080,823 B1 * 7/2015 Mantas ..... F41A 3/84
9,103,611 B2 * 8/2015 Neitzling ..... F41A 3/78
9,347,725 B2 * 5/2016 McAlister ..... F41A 19/08
9,347,738 B1 * 5/2016 Schumacher ..... F41A 3/26
9,921,013 B1 * 3/2018 Oglesby ..... F41A 3/80
9,970,722 B1 * 5/2018 Babb ..... F41A 3/82
9,995,553 B1 * 6/2018 Oglesby ..... F41A 3/80
10,323,891 B1 * 6/2019 Zheng ..... F41A 3/84
10,393,483 B2 * 8/2019 Lu ..... F42B 4/04
10,422,595 B2 * 9/2019 Law ..... F41A 3/82
11,162,748 B2 * 11/2021 Noonan ..... F41A 11/00
2003/0101631 A1 * 6/2003 Fitzpatrick ..... F41C 23/14 42/72
2006/0236853 A1 * 10/2006 Boersching ..... F41A 3/70 89/198
2012/0297656 A1 * 11/2012 Langevin ..... F41A 3/84 42/16
2014/0041518 A1 * 2/2014 Neitzling ..... F41A 3/26 89/191.01
2014/0075798 A1 * 3/2014 Kincel ..... F41A 3/84 42/1.06
2014/0190056 A1 * 7/2014 Troy ..... F41C 23/06 42/71.01
2014/0260946 A1 * 9/2014 Gomez ..... F41A 3/84 42/71.01
2014/0373418 A1 * 12/2014 Hu ..... F41A 19/46 42/69.03
2015/0107143 A1 * 4/2015 Coetzee ..... F41G 11/003 42/14
2015/0300763 A1 * 10/2015 Huther ..... F41A 17/74 89/148
2015/0330728 A1 * 11/2015 McGinty ..... F41A 3/84 89/198
2015/0338181 A1 * 11/2015 McAlister ..... F41A 19/09 29/525.08
2015/0345895 A1 * 12/2015 Young ..... F41A 3/84 42/71.01
2015/0362270 A1 * 12/2015 Stewart ..... F41A 17/36 42/16
2016/0047612 A1 * 2/2016 Sullivan ..... F41A 5/26 42/25
2016/0116249 A1 * 4/2016 Maugham ..... F41C 23/08 42/74
2017/0234634 A1 * 8/2017 Hirt ..... F41A 5/18 89/193
2018/0274870 A1 * 9/2018 Law ..... F41A 3/82

* cited by examiner

BOLT ASSEMBLY

CROSS-REFERENCE TO RELATED APPLICATION

This application is a Continuation-in-Part of U.S. patent application Ser. No. 17/019,686 filed on Sep. 14, 2020 entitled "B.L.T. BOLT CARRIER," which is a Continuation-in-Part of U.S. patent application Ser. No. 15/718,081 filed on Sep. 28, 2017, entitled "B.L.T. BOLT CARRIER," which claims the benefit of U.S. Provisional Patent Application No. 62/400,826 filed on Sep. 28, 2016, entitled "BLT Bolt Carrier," which are hereby incorporated by reference in their entirety for all that is taught and disclosed therein.

U.S. patent application Ser. No. 17/019,686 filed on Sep. 14, 2020 entitled "B.L.T. BOLT CARRIER" also claims the benefit of U.S. Provisional Patent Application No. 62/906,161 filed on Sep. 26, 2019, entitled "B.L.T. Bolt Carrier," which is hereby incorporated by reference in its entirety for all that is taught and disclosed therein.

FIELD OF THE INVENTION

The present invention relates to firearms, and more particularly to a bolt assembly that enables pistol variants of the AR-15, as well as standard versions of the AR-15, M16 and M4 rifle and other firearm platforms that have the same dimensions to fit this invention, to omit an extension tube to reduce length, fire while folded/collapsed, or use a module-type stock.

BACKGROUND AND SUMMARY OF THE INVENTION

Normal AR-15, M16 and M4 rifles have an extension tube that extends to the rear of the upper receiver and contains the recoil spring. Given the length of the bolt carrier, the recoil spring needs the additional length supplied by the extension tube to compress and provide an adequate range of motion of the bolt carrier. The travel of the buffer to the rear of the extension tube causes the weapon to have more felt recoil due to more mass at the rear of the weapon, which is a disadvantage of a standard AR-15 recoil assembly. While the standard AR-15 recoil assembly is suitable for AR-15 rifles with normal shoulder stocks, the protruding extension tube is a problem for pistol variants of the AR-15 firearm platform, as well as for standard AR-15 rifles having folding, fully collapsing stocks, or modular stocks, which are incompatible with a fixed extension tube.

Therefore, a need exists for a new and improved bolt assembly that enables pistol variants of the AR-15 firearm platform to omit an extension tube to reduce length. In this regard, the various embodiments of the present invention substantially fulfill at least some of these needs. In this respect, the bolt assembly according to the present invention substantially departs from the conventional concepts and designs of the prior art, and in doing so provides an apparatus primarily developed for the purpose of enabling variants of the AR-15 firearm platform to omit an extension tube to reduce length and enable the firearm to fire while folded or fully collapsed.

The present invention provides an improved bolt assembly, and overcomes the above-mentioned disadvantages and drawbacks of the prior art. As such, the general purpose of the present invention, which will be described subsequently in greater detail, is to provide an improved bolt assembly that has all the advantages of the prior art mentioned above.

To attain this, the preferred embodiment of the present invention essentially comprises a rear block configured for connection at the rear end of the bolt passage, a bolt carrier configured to reciprocate in the bolt passage, a support element between the rear block and the bolt carrier, a first spring between the support element and the rear block, the bolt carrier defining a bore, the support element including a guide rod slidably received in the bore, and a second spring encompassing the guide rod, having a rear end abutting the support element, and a forward portion received in the bore. The bolt carrier may include a bolt carrier body, and the bolt carrier may include a weight portion movably connected to the bolt carrier body. The weight portion may define a through hole receiving an intermediate portion of the guide rod and an intermediate portion of the second spring. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
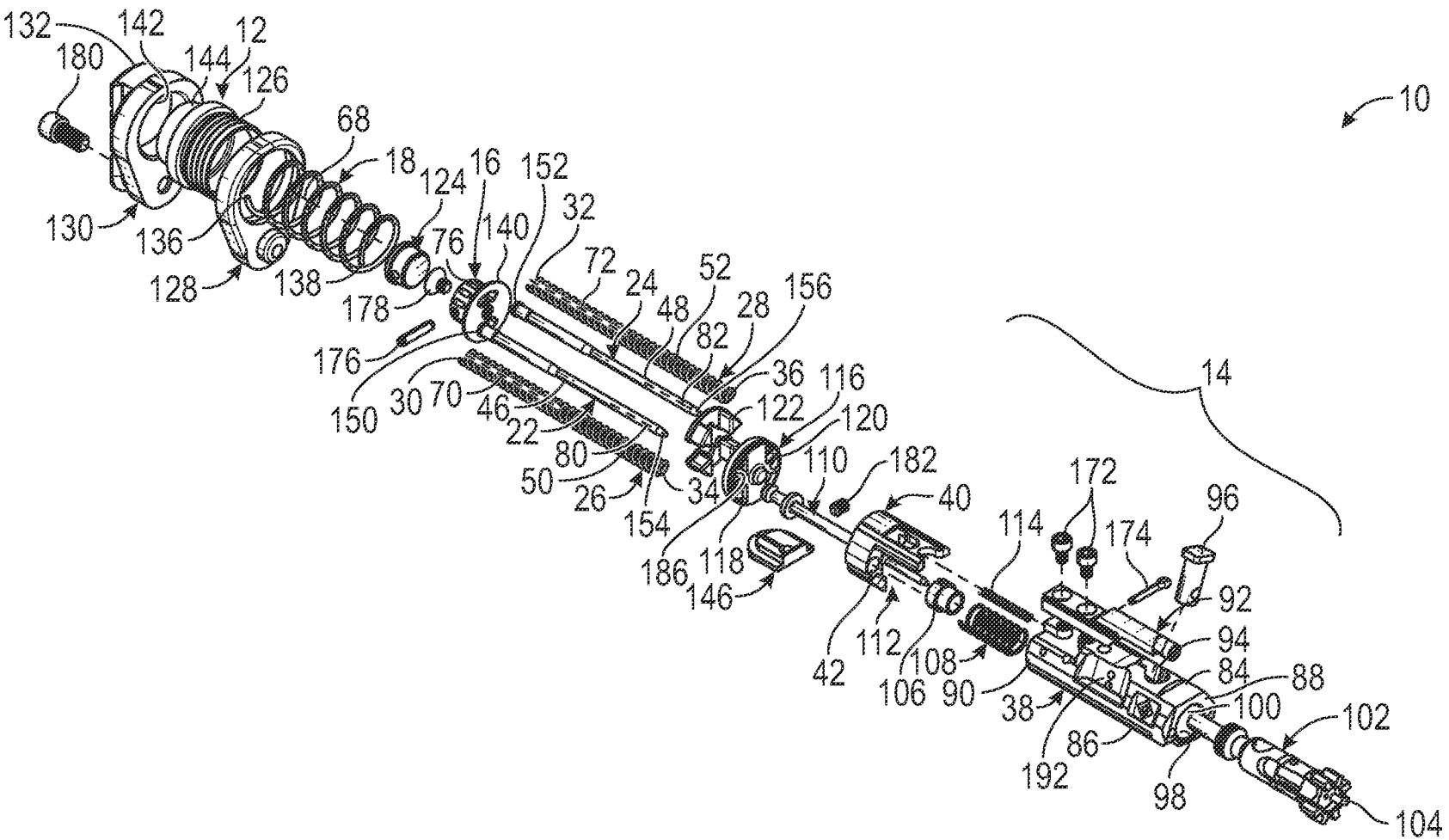
FIG. 1 is a front exploded view of the current embodiment of a bolt assembly constructed in accordance with the principles of the present invention.
Figure 2:
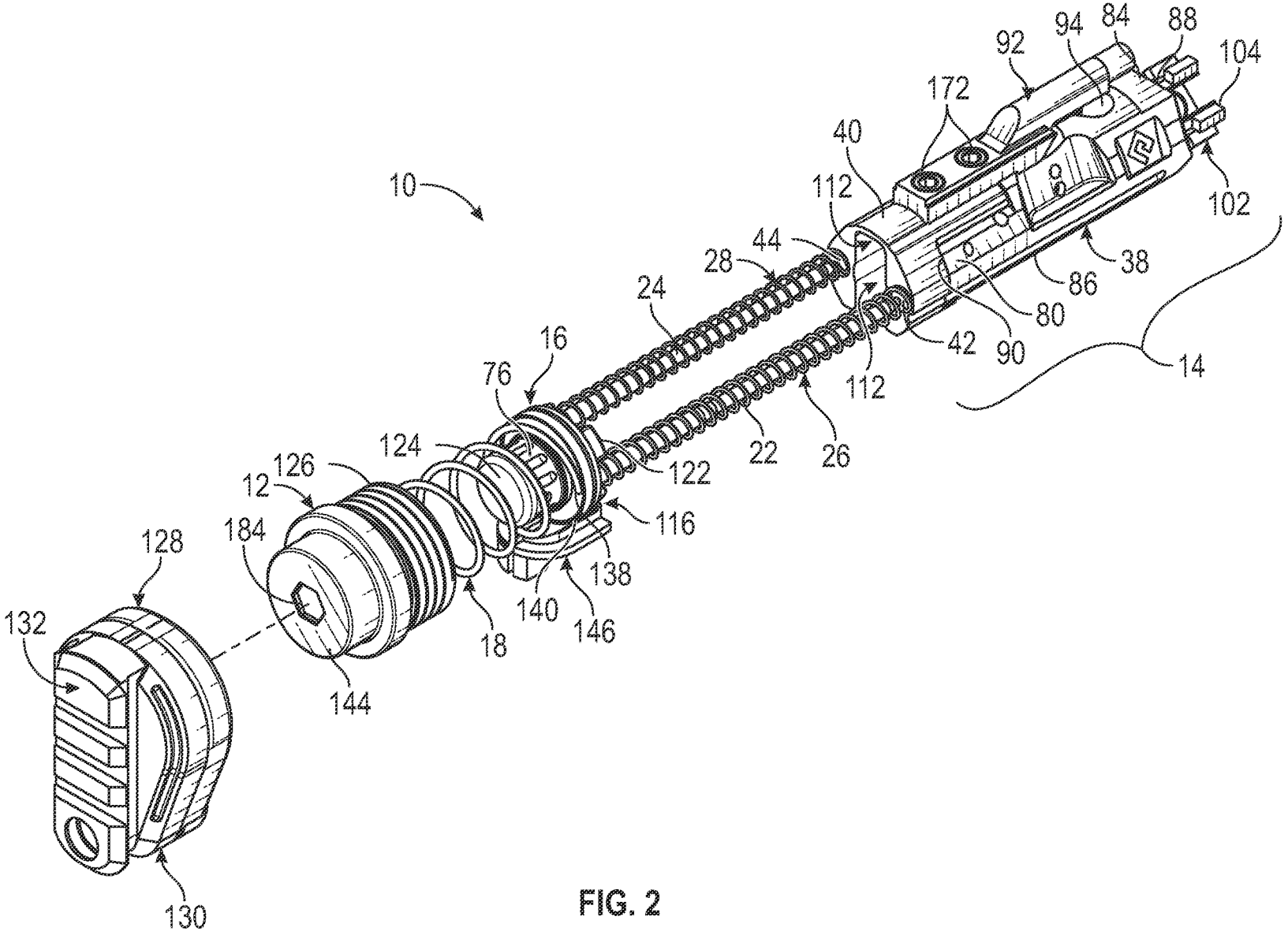
FIG. 2 is a rear assembled view of the bolt assembly of FIG. 1.
Figure 3:
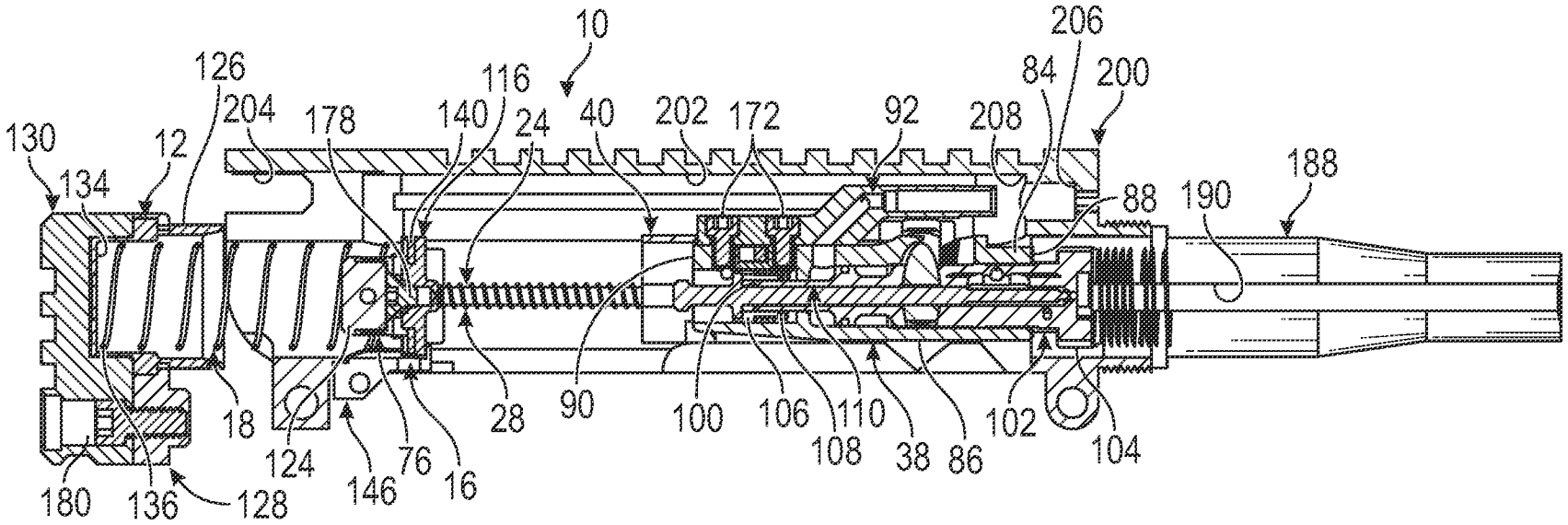
FIG. 3 is a side sectional view of the bolt assembly of FIG. 1 in the forward battery condition.
Figure 4:
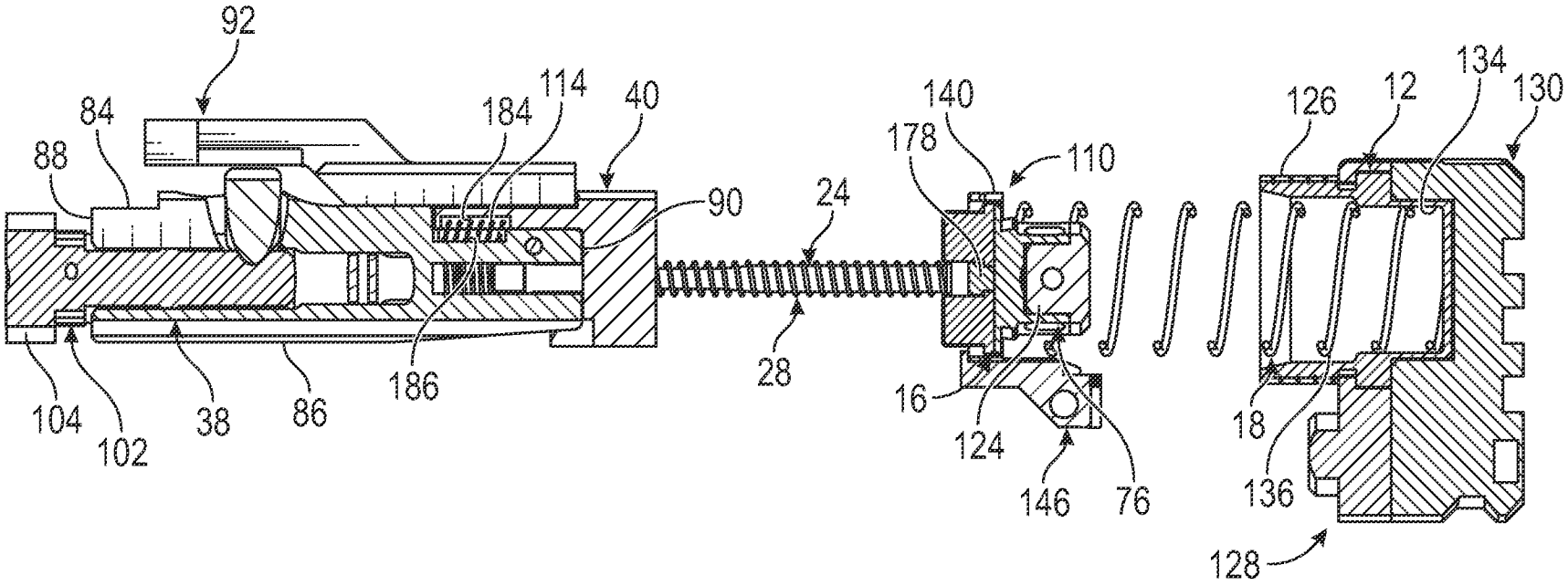
FIG. 4 is a side sectional view of the bolt assembly of FIG. 1 in the forward battery condition.

An embodiment of the bolt assembly of the present invention is shown and generally designated by the reference numeral 10.

FIGS. 1-7 and 12 illustrate the improved bolt assembly 10 of the present invention. More particularly, the bolt assembly is suitable for use with a firearm frame/upper receiver 200 defining an elongated bolt passage 202 having a rear end 204 and a forward end 206. The bolt assembly is shown in the forward battery position in FIGS. 3, 4, 6, and 12 and in the rearward recoil position in FIGS. 5 and 7. The bolt assembly has a rear block 12 configured for connection at the rear end of the elongated bolt passage, a bolt carrier 14 configured to reciprocate in the bolt passage, a rear support element 16 that incorporates a rear-facing bump stop 124 for the bolt carrier between the rear block and the bolt carrier, and a first spring 18 between the support element and the rear block. The bolt carrier defines a pair of parallel first and second bores (right bore 20 and left bore 158 are visible in FIG. 12). The rear support element includes a pair of parallel guide rods (right and left guide rods 22, 24) slidably received in the right and left bores. A pair of parallel right and left second springs 26, 28 encompass the right and left guide rods. The right and left second springs each have a rear end 30, 32 abutting the rear support element and a forward portion 34, 36 received in the right and left bores. The bolt carrier includes a bolt carrier body 38 with a dust cover cutout 192 and the bolt carrier includes a weight portion 40 movably connected to the bolt carrier body. The weight portion defines a pair of parallel through holes (right and left through holes 42, 44), each receiving an intermediate portion 46, 48 of the right and left guide rods and an intermediate portion 50, 52 of the right and left second springs.

The right bore 20 of the bolt carrier has a rear portion 54 having a rear diameter 56 sized to closely and slidably receive the forward portion 34 of the right second spring 26, and a smaller forward portion 58 with a forward diameter 60 sized to closely receive the right guide rod 22, with a step surface 62 in the right bore upon which a forward end 64 of the right second spring bears. Thus, the forward end of the right second spring bears on the bolt carrier body 38 well forward of the rear 90 of the bolt carrier body, thereby telescoping the right second spring within the length of the bolt carrier body and reducing the operating length of the bolt carrier assembly 10. The left bore 158 of the bolt carrier has a rear portion 160 having a rear diameter 162 sized to closely and slidably receive the forward portion 36 of the left second spring 28, and a smaller forward portion 164 with a forward diameter 166 sized to closely receive the left guide rod 24, with a step surface 168 in the left bore upon which a forward end 170 of the left second spring bears. Thus, the forward end of the left second spring bears on the bolt carrier body well forward of the rear of the bolt carrier body, thereby telescoping the left second spring within the length of the bolt carrier body and reducing the operating length of the bolt carrier assembly 10. The first spring 18 defines a first axis 68, and the right and left second springs define right and left second axes 70, 72, the first axis and right and left second axes being at the same level to define a horizontal plane 74 when the firearm frame/upper receiver 200 is in an upright operational orientation. The rear support element 16 includes a first spring alignment element/first spring engagement facility 76 configured to retain the first spring on a first spring axis 78. The first spring is oriented on the first spring axis in registration with the first spring alignment element/first spring engagement facility. The right and left guide rods define respective second and third axes (right and left guide rod axes 80, 82). The first axis, first spring axis, and the second and third axes define a common plane (horizontal plane 74). The second and third axes are lateral to the first axis and first spring axis. The second and third axes are on opposite sides of the first axis and first spring axis.

The bolt carrier body 38 has a top 84, bottom 86, front 88, and rear 90. A gas key 92 is attached to the top by two set screws 172. The top also defines a cam slot 94 that receives a cam pin 96. The front defines a central bore 98 that receives the rear 100 of a bolt 102. A forward portion 104 of the bolt extends beyond the front of the bolt carrier body to engage a United States military standard specification (milspec) or otherwise standard barrel 188 having a rear chamber 190. The central bore in the bolt carrier body extends the length of the bolt carrier body such that the rear of the bolt carrier body receives a firing pin plunger 106, firing pin plunger spring 108, and firing pin 110. The firing pin is retained by firing pin retaining pin 174. The weight portion 40 defines a slot 112 to permit the firing pin to access the firing pin plunger and the rear of the bolt. The weight portion is slidably connected to the rear of the bolt carrier body and is biased rearwardly by a weight portion spring 114. The cam pin, central bore, bolt, set screws, firing pin, and firing pin retaining pin are all made to United States military standard specifications (milspec) in the current embodiment.

A front support element 116 having right and left through holes 118, 120 is located between the weight portion 40 and the rear support element 16. The right and left through holes permit passage of the right and left guide rods 22, 24, but do not permit passage of the right and left second springs 26, 28. Thus, the right and left second springs bias the front support element and rear support element 16 away from the weight portion 40 of the bolt carrier 14. The front support element includes bump stops 122 that extend forwardly through through holes 186 so as to be positioned between the front support element and the weight portion and secured by rear support element 16 when secured by screw 178. A bump stop 124 is positioned between the rear support element 16 and the rear block 12. The bump stop is secured by spring pin 176. A screw 178 connects the front and rear support elements with bump stop 122 in between the front and rear support elements and extending through through holes 186. The rear block has a forward threaded portion 126 to configure the rear block for connection to the firearm lower milspec frame/receiver (not shown) on existing threads where a milspec/standard buffer tube might normally be attached at the rear end of a milspec/standard lower frame/receiver. In the current embodiment, the threaded portion has a 1 3/16"-16 tpi pitch to match a milspec/standard lower frame/receiver. Thus, the rear block becomes the rear wall when attached to the firearm lower frame/receiver and a fixed frame of reference the bolt carrier 14 reciprocates with respect to. An adapter interface mount 128 connects an adapter interface 130 to the firearm frame by the rear block 12 securing the adapter interface mount to the lower frame/receiver. The adapter interface is secured to the adapter interface mount by screw 180. The adapter interface includes a 1913-style Picatinny rail 132, but other styles of adapter mounts can be substituted on the adapter interface mount 128 to accommodate a greater variety of stock variants or other accessories to be attached to the firearm frame. The rear block 12 defines a first spring pocket 134 that receives the rear end 136 of the first spring 18. The forward end 138 of the first spring abuts a flange 140 on the rear support element 16. The adapter interface defines a rear block pocket 142 that receives the rear end 144 of the rear block. The rear end of the rear block includes a socket head 184 to facilitate threadedly securing the rear block to the firearm lower frame/receiver. A recoil assembly catch 146 attaches into the milspec/standard upper receiver 200 to prevent overtravel of the bolt carrier. The recoil assembly catch is held tightly in place in the firearm frame/upper receiver by set screw 182.

Figure 5:
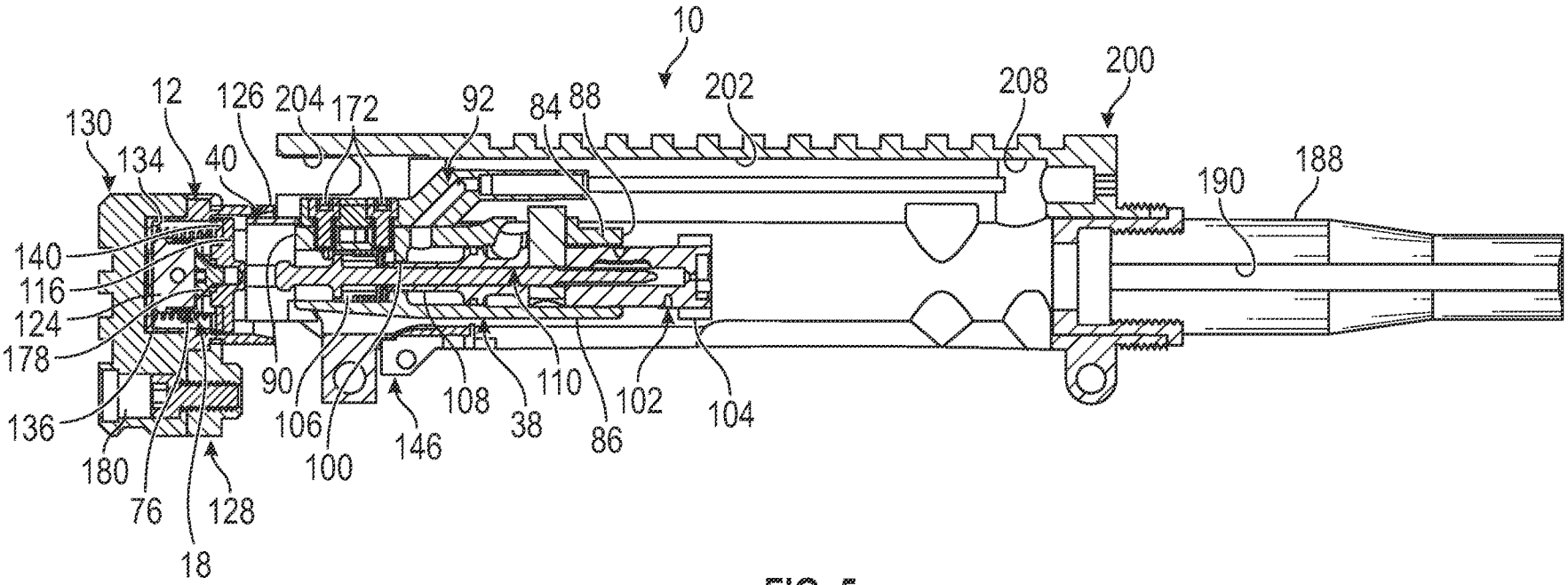
FIG. 5 is a side sectional view of the bolt assembly of FIG. 1 in the rearward recoil condition.
Figure 6:
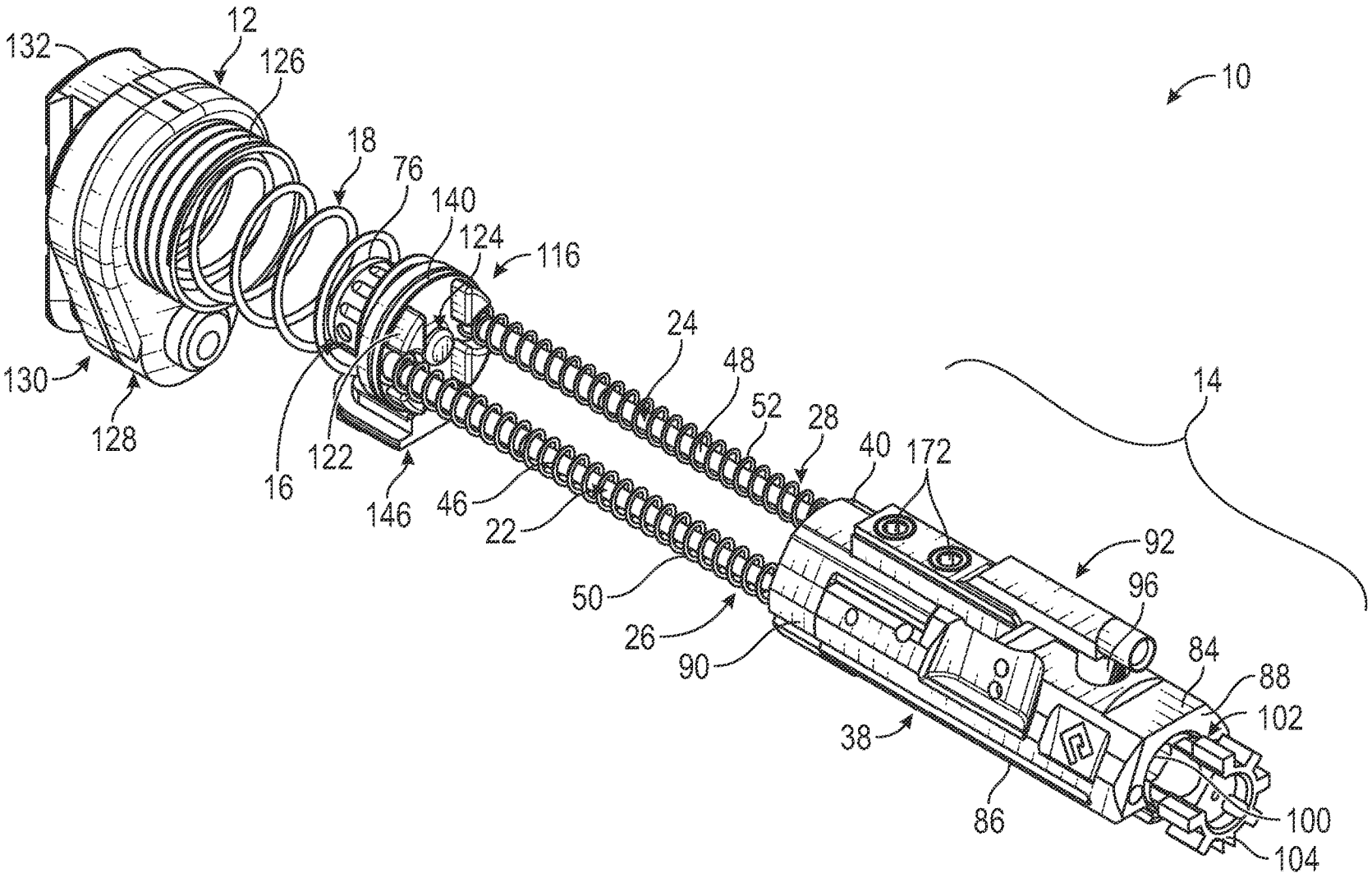
FIG. 6 is a front isometric view of the bolt assembly of FIG. 1 in the forward battery condition.

Referring now to FIG. 5, it should be appreciated that in the rear recoil position, the components of the bolt carrier assembly are arranged in the following order from rear to front: the Picatinny rail 132, the adapter interface 130, the rear end 144 of the rear block 12, the rear of the first spring pocket 134, the rear end 136 of the first spring 18, the bump stop 124, the first spring engagement facility 76 on the rear support element, the adapter interface mount 128, the front end 138 of the first spring, the flange 140 on the rear support element, the rear ends 150, 152 of the right and left guide rods 22, 24, the threaded portion 126 of the rear block, the front support element 116, the bump stops 122, the rear ends 30, 32 of the right and left second springs 26, 28, the weight portion 40, the rear 90 of the bolt carrier body 38, the forward ends 64, 66 of the right and left second springs, the forward ends 154, 156 of the right and left guide rods, the front 88 of the bolt carrier body, and the forward portion 104 of the bolt 102.

Figure 7:
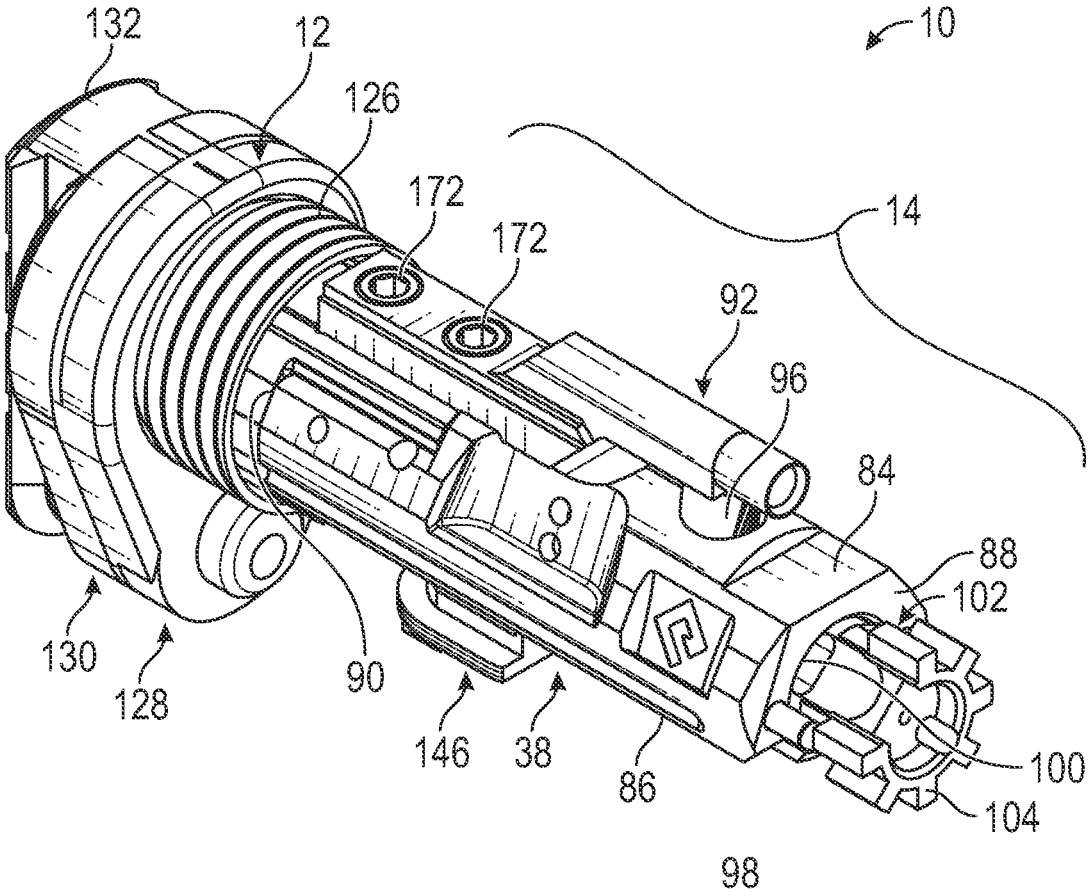
FIG. 7 is a front isometric view of the bolt assembly of FIG. 1 in the rearward recoil condition.

As is shown in FIG. 7, the bolt carrier 14 reaches the rearward recoil position in the same distance as a conventional AR-15 rifle with an extension tube. In fact, the shorter than standard bolt carrier operates fully within the limited length of an AR-15 firearm frame and does not require an extension tube. In the current embodiment, the bolt carrier is 2.5 inch shorter than a standard bolt carrier. Elimination of the extension tube, which ranges from 3.25 inch for a carbine extension tube to 6.0 inch for a rifle-length extension, shortens the overall firearm.

Furthermore, because of the multispring resonance in the operating distance, the weight of the bolt carrier assembly 10 operates closely to the center axis of the firearm frame 200. This reduces the recoil sensation felt by the user because muzzle flip is reduced. The use of multiple springs in the current invention instead of the much longer single rear spring used in a conventional AR-15 rifle has multiple advantages. First, the current invention enables the recoil forces to be absorbed closely along the center axis of the firearm. Second, the current invention prevents problems associated with stacking the coils of a longer spring against each other that would otherwise occur with such a short bolt carrier. Hammer interference would also occur if a traditional single spring was used. The first spring and right and left second springs are essentially end to end, and the entire first spring remains to the rears of the entire right and left second springs in all conditions. The first spring and right and left second springs are serially connected with the front and rear support elements 116, 16 compressed between them, and each of the springs has a size and shape to closely fit within the space provided for that spring within the bolt carrier assembly 10.

Figure 8:
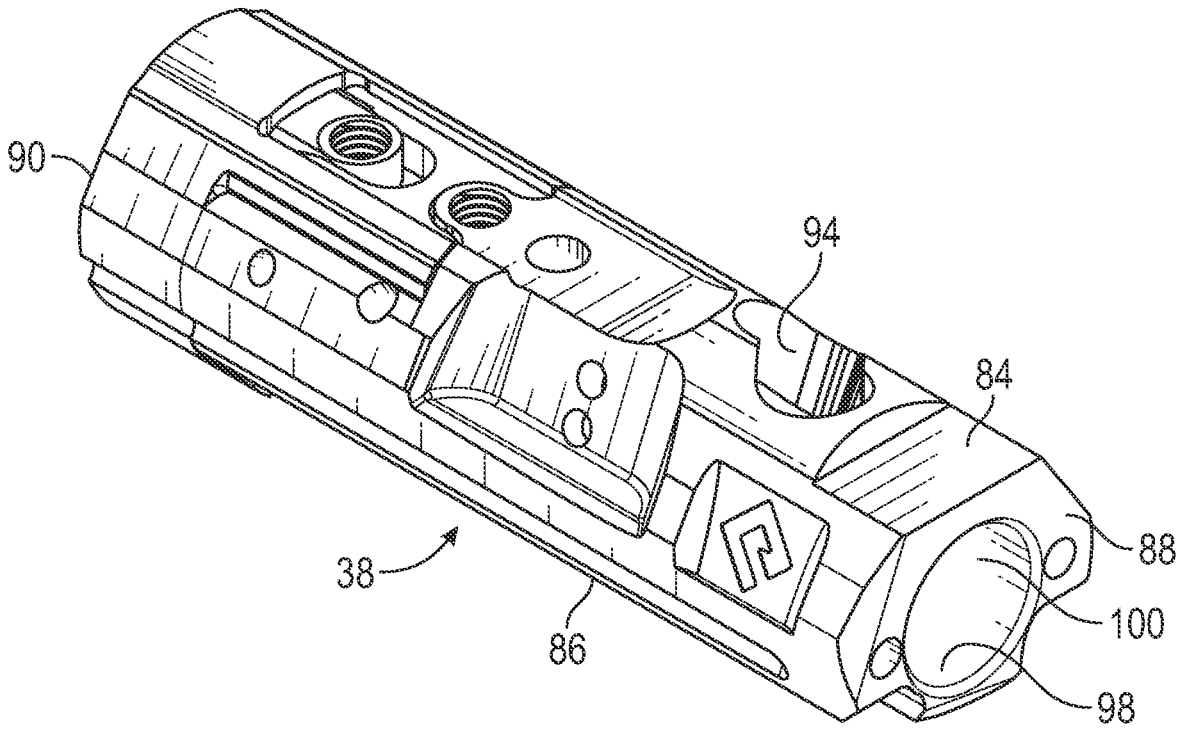
FIG. 8 is a front isometric view of the bolt carrier of FIG. 1 in the forward battery condition.
Figure 9:
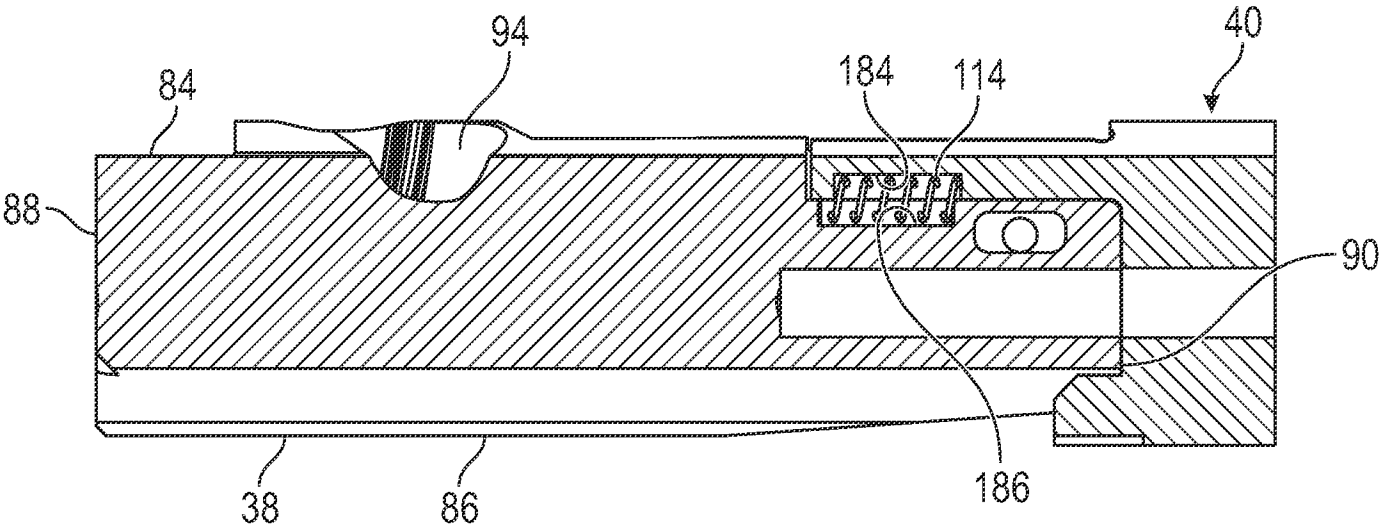
FIG. 9 is a side sectional view of the bolt carrier of FIG. 1 in the forward battery condition with the slide weight in the closed position.
Figure 10:
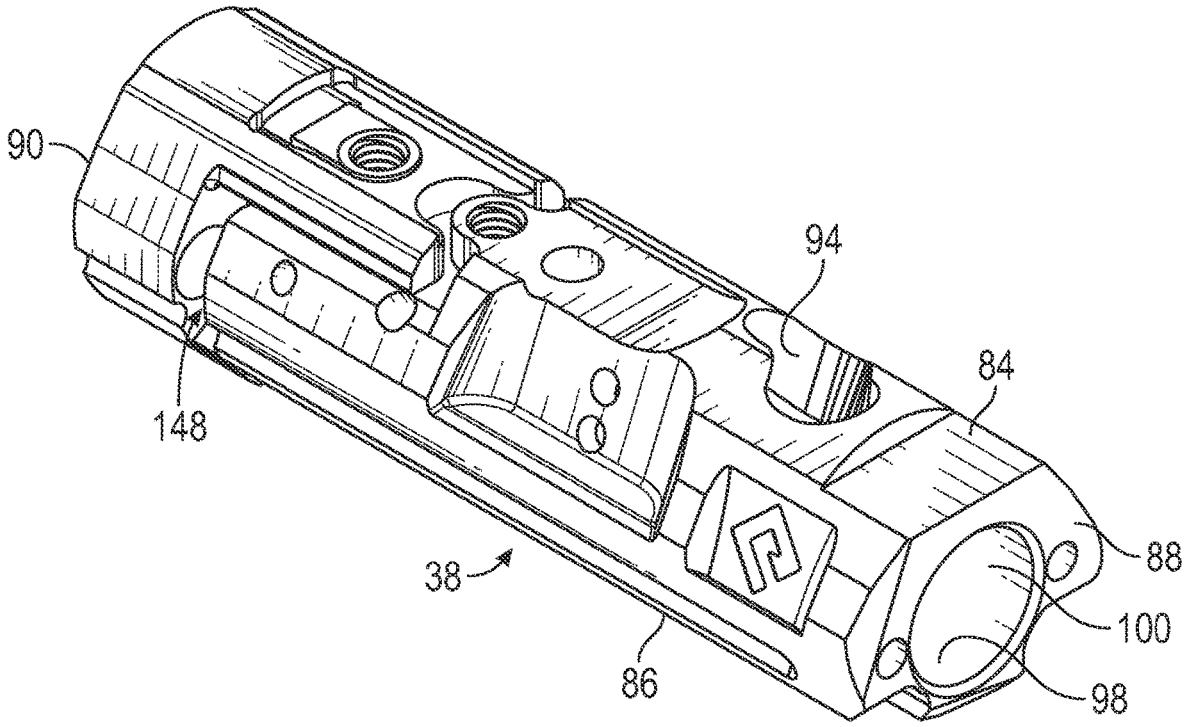
FIG. 10 is a front isometric view of the bolt carrier of FIG. 1 with the slide weight in the open position after absorbing kinetic energy of the bolt, thereby reducing bolt.
Figure 11:
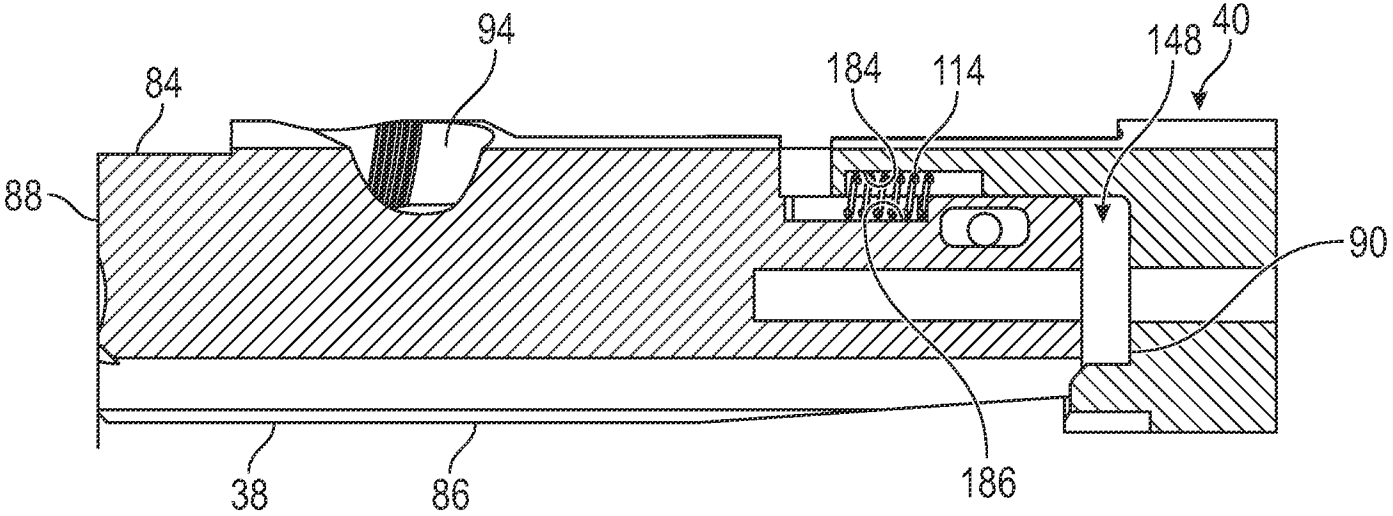
FIG. 11 is a side sectional view of the bolt carrier of FIG. 1 with the slide weight in the open position after absorbing kinetic energy of the bolt, thereby reducing bolt bounce.
Figure 12:
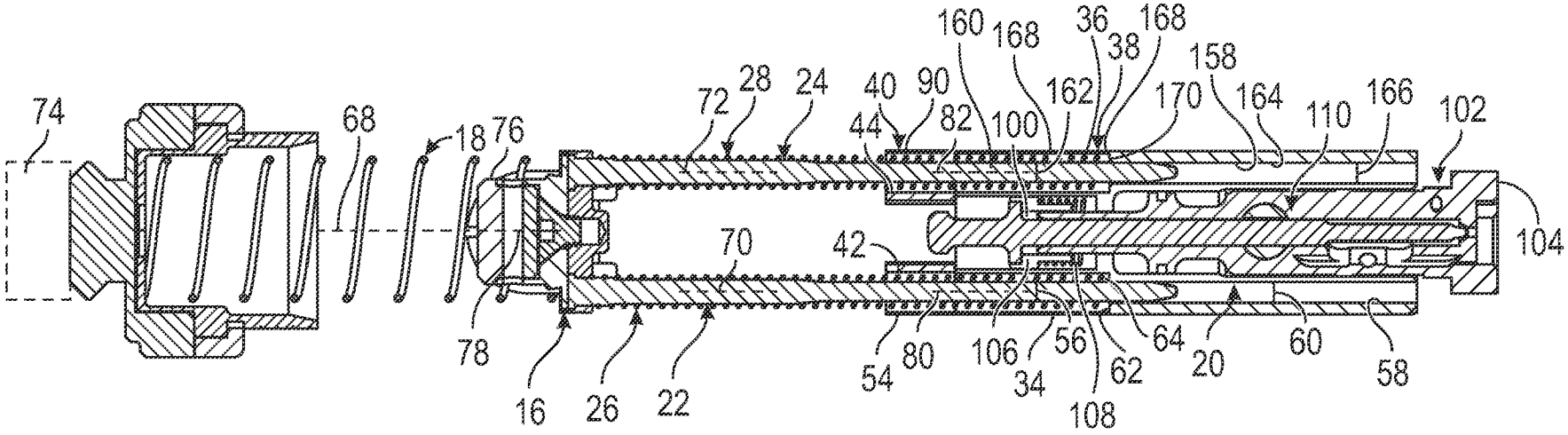
FIG. 12 is a top sectional view of the bolt assembly of FIG. 1 in the forward battery condition.

FIGS. 8-11 illustrate the improved bolt carrier 14 of the present invention. More particularly, FIGS. 8 and 9 show the bolt carrier in the forward battery position, and FIGS. 10 and 11 show the bolt carrier with the weight 40 in the open position from absorbing the kinetic energy, thereby reducing bolt bounce. In the forward battery position, the weight portion spring 114 held in top pocket half 184 in the weight portion 40 and bottom pocket half 186 in the bolt carrier body 38 biases the weight portion 40 pushes forward to close a gap 148 between the weight portion and the rear 90 of the bolt carrier body 38. In the recoil condition, recoil forces push the bolt carrier body rearward, which compresses right and left second springs 26, 28 (not shown) and first spring 18. Compression eventually stops rearward movement of the bolt carrier when the bolt carrier has reached the rearward recoil position. When the bolt carrier and bolt 102 are locked into battery, the weight 40 absorbs the kinetic energy of the assembly and separates from the rear 90 of the bolt carrier, thus creating a gap 148. The gap ensures the bolt carrier maintains proper lock and reduces bolt bounce, creating a dead blow effect. In some circumstances and operations, the weight's operation is reversed and the gap 148 is normally open, the weight portion spring 114 is held by the bolt carrier and pushes the weight 40 open. In the recoil condition, recoil forces push the bolt carrier body rearward, which compresses the weight portion spring and right and left second springs 26, 28 (not shown). The compression of the three springs causes the gap between the weight portion and the rear of the bolt carrier body to close such that the bolt carrier body impacts the weight portion, which slows the bolt carrier body. The bolt carrier body also transfers rearward force through the weight portion onto the components rearward of the weight portion. Compression of the first spring 18 and second springs 26, 28 eventually stops rearward movement of the bolt carrier when the bolt carrier has reached the rearward recoil position. When the bolt carrier is returning to the forward battery condition and stripping the next round from the magazine (not shown), the weight portion spring separates the weight portion from the rear of the bolt carrier body to restore the gap. When the bolt carrier and bolt 102 lock into battery, the weight portion continues forward from the inertia, compresses the weight portion spring, and impacts the rear of the bolt carrier body. Thus, the weight portion gives a dead blow effect to the bolt carrier body, thereby ensuring proper lockup and reducing bolt bounce. The weight portion spring then restores the gap. In both methods of weight 40 operation, the weight portion travels on a linear path between the two positions illustrated in FIGS. 8 and 9 and 10 and 11. The spring pressure exerted by the weight portion spring causes the gap between the weight portion and the rear of the bolt carrier body to be between 0.05" and 0.25" depending on the host firearm's characteristics (caliber, barrel length, and whether a suppressor is used). The weight portion is secured by the gas key 92 in the current embodiment, but can also be secured using other approaches if the bolt carrier has an integrated gas key or a modified gas system.

FIGS. 1, 3, 5 and 12 illustrate the improved firing pin safety feature. In a traditional milspec bolt carrier, the firing pin 110 is a free float design. To add a modern safety feature, the invention includes a spring plunger 106 with a plunger spring 108 in front of the firing pin to eliminate the free float firing pin.

Bolt carrier 38 may or may not have a dust cover cutout 192 depending on user preference. The bolt carrier may have a modified half cutout to keep guide rod bore 20 safe from the elements, or the bolt carrier may have a standard full-size cutout, (not shown, guide rod bore 20 is visible) depending on consumer preference. The dust cover cutout can be designed to use milspec/standard dust covers (not shown). A modified half dust cover cutout needs a dust cover with a modified detent footprint to fit the half dust cover cutout. A detent and spring are held in place by a wire clip or detent pressed into place with or without a wire clip. Instead of the normal milspec detent length of about ½ inch, the length of the detent for the modified half dust cover needs to be ¼ inch or smaller to fit the half dust cover cutout. Along with a smaller detent footprint, the modified half dust cover needs the modified shortened detent and a new means of securing the detent using a wire clip, a press fit, or both. All other dimensions of the half dust cover are standard and a standard way of securing the cover to the frame/upper receiver is used.

In the context of the specification, the terms "rear" and "rearward," and "front" and "forward," have the following definitions: "rear" or "rearward" means in the direction away from the muzzle of the firearm while "front" or "forward" means it is in the direction towards the muzzle of the firearm.

While a current embodiment of a bolt assembly has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bolt assembly for a firearm frame defining an elongated bolt passage having a rear end and a forward end, the bolt assembly comprising:

a rear block configured for connection at the rear end of the bolt passage;

a bolt carrier configured to reciprocate in the bolt passage;

a support element between the rear block and the bolt carrier;

a first spring between the support element and the rear block;

the bolt carrier defining a bore having a forward bore portion with a first bore diameter, and a rear bore portion with a second bore diameter greater than the first bore diameter;

the support element including a guide rod having a forward guide rod portion configured to be slidably received in the forward bore portion, and a rear guide rod portion having a diameter greater than the forward guide rod portion; and a second spring encompassing the rod and having an exterior diameter less than the second bore diameter and greater than the first bore diameter, having a rear end abutting the support element, and a forward portion received in the rear bore portion.

2. The bolt assembly of claim 1 wherein the bolt carrier includes a bolt carrier body, and the bolt carrier includes a weight portion movably connected to the bolt carrier body.

3. The bolt assembly of claim 2 wherein the weight portion defines a through hole receiving an intermediate portion of the guide rod and an intermediate portion of the second spring.

4. The bolt assembly of claim 1 wherein the bore of the bolt carrier has a rear portion having a rear diameter sized to closely receive the forward portion of the second spring, and a smaller forward portion with a forward diameter sized to closely receive the guide rod, with a step surface in the bore upon which a forward end of the second spring bears.

5. The bolt assembly of claim 1 wherein the first spring defines a first axis, and the second spring defines a second axis, the first and second axes being at the same level to define a horizontal plane when the firearm frame is in an upright operational orientation.

6. The bolt assembly of claim 1 wherein the support element includes a second guide rod slidably received in a second bore of the bolt carrier.

7. The bolt assembly of claim 6 wherein the support element includes a first spring alignment element configured to retain the first spring on a first axis, and wherein the guide rods define respective second and third axes, the first, second and third axes defining a common plane.

8. The bolt assembly of claim 7 wherein the common plane is in a horizontal orientation when the frame is in an upright position.

9. The bolt assembly of claim 6 wherein the second and third axes are lateral to the first axis.

10. The bolt assembly of claim 6 wherein the second and third axes are on opposite sides of the first axis.

11. The bolt assembly of claim 1 wherein the rear guide rod portion has a diameter greater than the forward bore portion.

12. The bolt assembly of claim 1 wherein the spring closely received the rear guide rod portion and more loosely receives the forward guide rod portion.

13. The bolt assembly of claim 1 wherein the guide rods are connected only at their rear ends and their forward portion are supported by the forward bolt bore portions.

14. A bolt assembly for a firearm frame defining an elongated bolt passage having a rear end and a forward end, the bolt assembly comprising:

a rear block configured for connection at the rear end of the bolt passage;

a bolt carrier configured to reciprocate in the bolt passage;

a support element between the block and the bolt carrier and having a first spring engagement facility defining a first spring axis;

a first spring between the support element and the rear block and oriented on the first spring axis in registration with the first spring engagement facility;

the bolt carrier defining a pair of parallel first and second bores;

the support element including first and second guide rods slidably received in the first and second bores and defining respective guide rod axes;

the guide rod axes being on opposite sides of the first spring axis; and the guide rod each having forward guide rod portions of a first diameter, and rear guide rod portions of a greater second diameter.

15. The bolt assembly of claim 14 wherein the guide rod axes and first spring axis define a common plane.

16. The bolt assembly of claim 14 wherein the guide rod axes are lateral to the first spring axis.

17. The bolt assembly of claim 14 wherein the guide rod axes are on opposite sides of the first spring axis.

* * * * *